United States Patent [19]

Peterson

[11] 4,170,252

[45] Oct. 9, 1979

[54] VARIABLE FLOW FUNNEL CONSTRUCTION

[76] Inventor: Gary J. Peterson, P.O. Box 822, Homer, Ak. 99603

[21] Appl. No.: 923,935

[22] Filed: Jul. 13, 1978

[51] Int. Cl.[2] ..... B67C 11/00

[52] U.S. Cl. ..... 141/331; 141/367; 222/434

[58] Field of Search ..... 141/392, 199–205, 141/297–300, 98, 331–345, 152, 177, 266, 376, 378, 367, 368; 222/282, 434

[56] References Cited

U.S. PATENT DOCUMENTS 2,761,607 9/1956 Ayars ..... 141/152

*Primary Examiner*—Houston S. Bell

[57] ABSTRACT

Presented is a funnel construction adapted to fit various size containers which have openings of different sizes. The funnel is constructed in such a way that adjustment of various inserts may be made to vary the flow of liquids through the funnel in accordance with the size of the opening in which the funnel is inserted.

15 Claims, 9 Drawing Figures

VARIABLE FLOW FUNNEL CONSTRUCTION

BACKGROUND OF THE INVENTION

1. Field of the Invention

This invention relates to funnel-like structures used for pouring liquids through small openings in larger containers, and particularly pertains to a funnel construction which is adapted for use in container openings of different sizes with the flow of liquid through the funnel being selectively variable.

2. Description of the Prior Art

A search of the prior art has been made in Class 141, sub-classes 105, 297, 300, 331, 332 and 339; Class 222, sub-classes 566 and 570; and Class 220, sub-class 85 SP. As a result of the search, U.S. Pat. Nos. 559,905; 766,613; 915,843 and 1,676,986 were disclosed.

U.S. Pat. No. 559,905 teaches the concept of a funnel provided with screw threads at its lower end adapted to receive either a strainer or sprinkler unit, or smaller size attachments to adapt the funnel for filling containers having different size openings. The strainer or sprinkler units or smaller size attachments are disclosed as being merely attachments and do not constitute a permanent part of a composite assembly which may be adjusted to vary the flow of liquid through the funnel as taught by my invention.

U.S. Pat. No. 951,843 teaches the concept of providing air passageways through a funnel to permit the escape of air from the container being filled.

U.S. Pat. No. 1,676,986 also teaches the concept of a passageway formed on the interior of the funnel to permit the escape of air from the container being filled. Additionally, this patent teaches the concept of a threaded adapter fitted to the discharge end of the funnel which provides a connecting means for the attachment of a cap adapted to fit onto different size openings in containers. There appears to be no teaching in any of these patents of a variable flow funnel construction which incorporates in a composite permanent assembly, various size discharge tubes coaxially arranged to nest one within the other and movable axially to increase or decrease the flow of liquid through the funnel.

Accordingly, one of the objects of the invention is the provision of a variable flow funnel construction adapted to fit different size openings in containers to be filled with a liquid poured through the funnel construction.

Another object of the invention is the provision of a composite funnel structure incorporating means adapting it to fit different size openings in containers while permitting adjustment of the funnel components to control the flow of liquid therethrough.

Still another object of the invention is the provision of a variable flow funnel construction fabricated from synthetic resinous materials to provide an outer truncated conical shell portion having a generally cylindrical delivery tube forming an integral extension of the apex end of the truncated conical shell and defining the largest diameter delivery tube of the assembly and incorporating a plurality of smaller diameter delivery tubes coaxially arranged within the outer and larger diameter tube, the several inner delivery tubes being adjustable axially with respect to one another to control the volume of liquid flow through the funnel.

The prior art has taught the use of attachments which may be threaded on to the end of a delivery tube to reduce the diameter of the stream of liquid poured through the funnel. One disadvantage of such structures is that the union upon the funnel spout proper of the attachment is prone to leakage, while another disadvantage is that application of the attachment causes elongation of the funnel and therefore contributes to its instability during use. Accordingly, a still further object of the invention is the provision of a variable flow funnel construction incorporating coaxial delivery tubes adjustable axially and effectively shortening the funnel structure as the volume of flow increases, thereby increasing the stability of the funnel structure.

A still further object of the invention is the provision of means in connection with a multiple component variable flow funnel construction which incorporates threaded segments for retaining the components in adjustable relationship with each other of retention means that operate to prevent the inadvertent disassembly of the multiple component funnel construction when the threaded segments are disengaged.

Another object of the invention is the provision of an adjustable variable flow funnel construction in which means are provided to prevent the "whirlpooling" of liquid as it flows through the funnel spout or delivery tube.

The invention possesses other objects and features of advantage, some of which, with the foregoing, will be apparent from the following description and the drawings. It is to be understood, however, that the invention is not limited to the embodiment illustrated and described since it may be embodied in various forms within the scope of the appended claims.

SUMMARY OF THE INVENTION

In terms of broad inclusion, the adjustable variable flow funnel construction of the invention comprises a unitary outer or main shell having a truncated conical portion and incorporating at its apex end a generally cylindrical delivery tube having a length approximating the diameter of the conical shell at its base. Inserted within the delivery tube are a plurality of additional delivery tube inserts of diminishing diameter, each of the diminishing diameter delivery tube inserts including at one end seal means adapted to cooperate with a sealing surface formed on the next larger delivery tube or on the delivery tube of the outer shell, and intermediate their ends each delivery tube insert is provided with circumferentially spaced threaded segments adapted to be threadably engaged with correspondingly spaced threaded segments formed adjacent the associated end of the successively larger delivery tube associated therewith. Means are also provided to prevent inadvertent disassembly of the delivery tube inserts even when all of the threaded segments are disengaged.

DESCRIPTION OF THE PREFERRED EMBODIMENT

Figure 1:
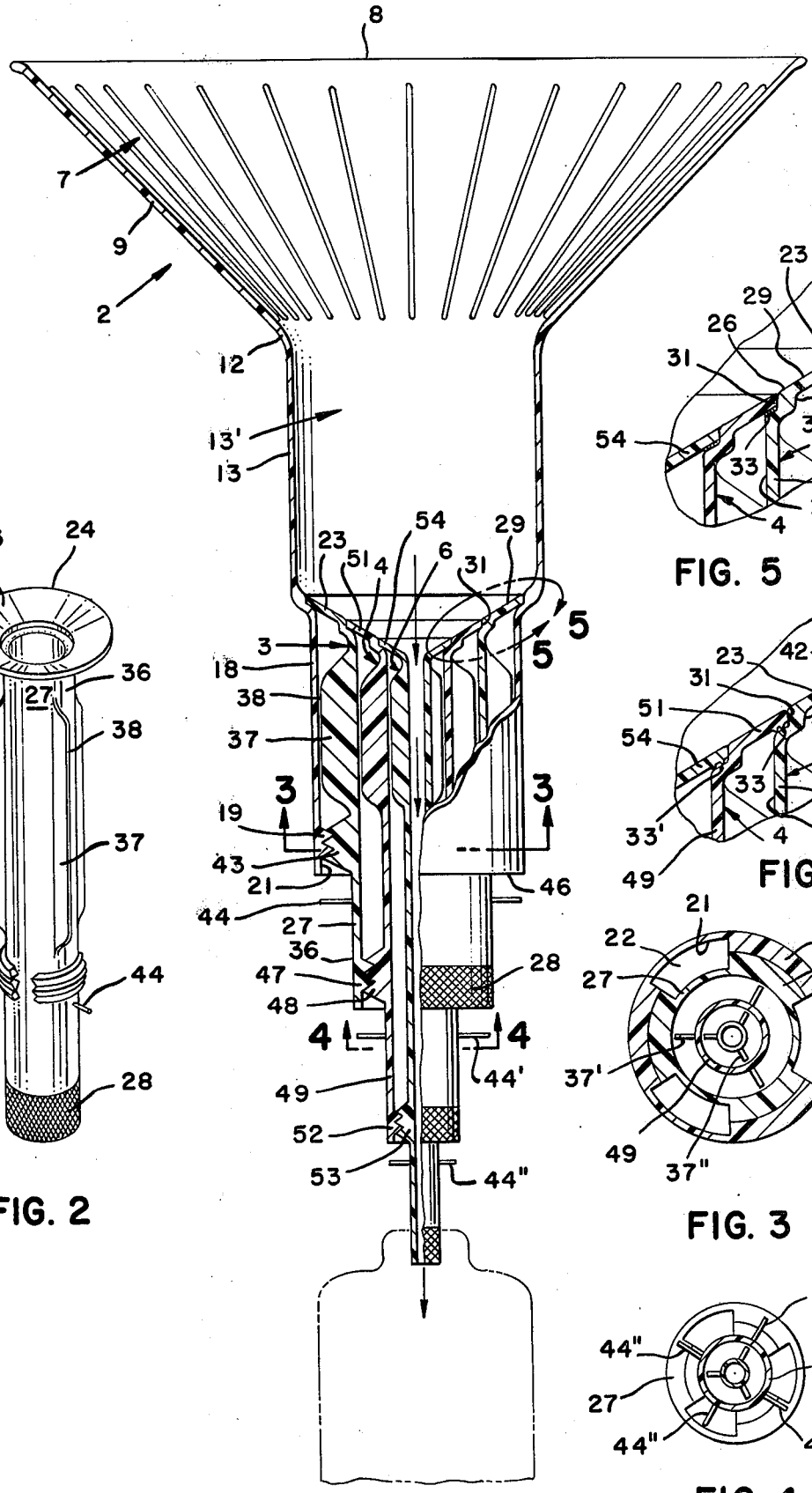
FIG. 1 is a vertical cross-sectional view illustrating the variable flow funnel construction adjusted for minimum volume flow.

In terms of greater detail, the variable flow funnel construction of the invention includes a cooperative assembly of four seprate components including an outer shell designated generally by the numeral 2, a next smaller shell constituting an insert and designated generally by the numeral 3, a third shell 4 also constituting an insert proportioned to fit coaxially within the insert shell 3, and a fourth shell designated generally by the numeral 6, and proportioned to fit coaxially within the insert shell 4. It should be understood that the insert shells 3, 4 and 6 are essentially identical in their conformation, but different in size, so that these three shells may be nested in coaxial relationship and the sub-assembly so formed inserted into the outer shell 2.

The purpose of this invention is to provide in one composite structure having a plurality of separate components, a funnel structure that can be adapted to fit various size openings in containers and which may be adjusted so that the flow of liquid through the funnel in terms of volume is correlated to the size of the opening into which the delivery tube portion of the funnel is inserted. To achieve this result, the outer shell 2 is formed, preferably, from a suitable synthetic resinous material that is resistent to oil and gasoline and is preferably molded as a single unit or component to provide a generally hollow conical shell portion 7 having a large diameter open base end 8 connected by the conical side wall 9 with the apex end 12 which, as clearly shown, merges smoothly and integrally with the upper portion 13 of the depending generally cylindrical delivery tube 13'.

Intermediate its ends, the cylindrical side wall of the delivery tube is provided with first and second annular surfaces 14 and 16, respectively, the two surfaces being off-set by a vertical cylindrical surface 17 so that the first surface 14 lies below the surface 16 but parallel thereto, with the surface 16 consituting a narrow annular conical surface or shoulder formed intermediate the ends of the delivery tube. The first and lower surface 14, on the other hand, is radially spaced inwardly from the surface 16, the outer periphery of the surface 14 being coincident with the vertical cylindrical surface 17 and the inner periphery of surface 16, and thus also constitutes a narrow annular conical surface next adjacent the continuation 18 of the now reduced-in-diameter delivery tube. The wall portion on which these two first and second surfaces are formed constitutes an integral portion 19 of the delivery tube and is generally conical in its configuration so that the delivery tube continuation portion 18 is small in diameter than the upper portion 13.

Referring to the delivery tube 13', it will be noted that the lower end continuation portion 18 thereof is provided internally with a plurality, preferably three, integral thread segments 19 spaced circumferentially about the interior surface 21 and arranged so that the threads formed in the three segments constitute a spiral continuation. The space 22 between adjacent threaded segments 19 is shorter in length than the length of the threaded segments. It will thus be seen that, if desired, the shell structure 2 without the sub-assembly formed by the insert shells 3, 4 and 6 can be used as a funnel since it provides the two components necessary for such a structure, namely, the conical shell portion 7 and the integral delivery tube 13'.

This structure, because of the large diameter of the delivery tube 13' is of course convenient for use in filling a container provided with a large aperture. It would of course not be appropriate for use in filling a container having an aperture smaller in diameter than the diameter of the delivery tube continuation portion 18. To fill such a container it would be necessary to use a different funnel having a delivery tube having a diameter correlated to the diameter of the opening in the container to be filled. With the subject matter of this invention, it is not necessary to utilize a separate or different funnel construction for this purpose since this structure is adapted to fit different size apertures in a manner which will now be explained.

Figure 2:
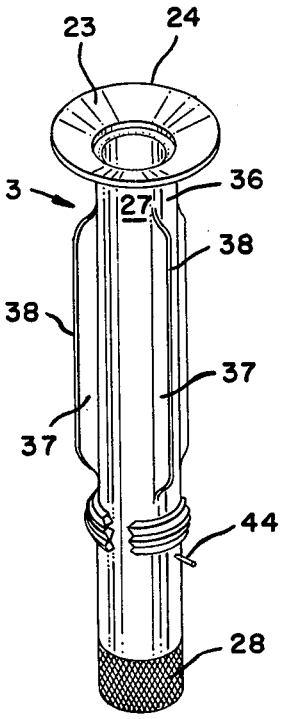
FIG. 2 is a perspective view of one of the adjustable delivery tube inserts adapted to be inserted into a larger diameter delivery tube, shown apart from the rest of the structure.
Figure 3:
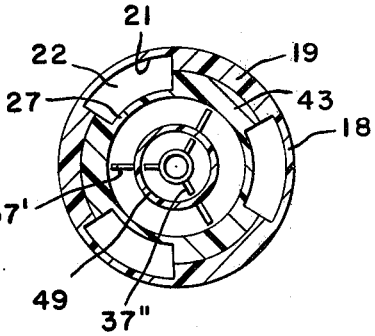
FIG. 3 is a horizontal cross-sectional view taken in the plane indicated by the line 3—3 of FIG. 1.
Figure 4:
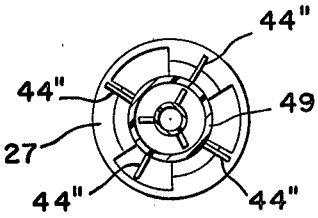
FIG. 4 is a horizontal cross-sectional view taken in the plane indicated by the line 4—4 in FIG. 1.
Figure 5:
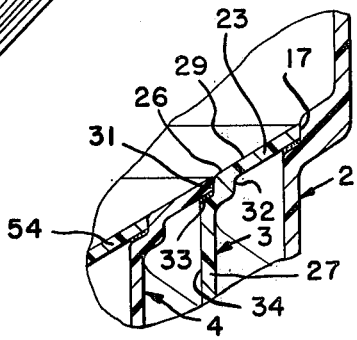
FIG. 5 is an enlarged fragmentary sectional view illustrating one seal embodiment for sealing the union between adjacent delivery tubes.
Figure 6:
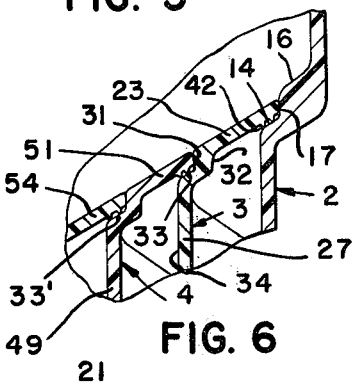
FIG. 6 is an enlarged fragmentary sectional view illustrating another seal embodiment for sealing the union between adjacent delivery tubes.

Referring to FIG. 2, it will be seen that the shell insert 3 is provided with a generally conical shell or flange portion 23 having a base edge or outer peripheral edge 24 and an apex end 26 integral with the upper end of cylindrical delivery tube 27 having a knurled surface 28 at its opposite end. The conical flange portion 23 is provided with a first conical surface 29 the apex end or inner peripheral portion of which merges smoothly with the interior surface 31 of a cylindrical flange portion 32 integral at its other end with the upper end of the delivery tube 27. The diameter of flange portion 32 is larger in diameter than the delivery tube 27, and their union is formed to provide a second conical surface 33 the apex end of which merges smoothly with the interior surface 34 of cylindrical delivery tube 27 while the base thereof is coincident with and merges smoothly into surface 31.

Formed on the exterior surface 36 of the delivery tube 27 are a plurality of radially extending baffle plates 37 positioned circumferentially at approximately 120° intervals about the periphery of the delivery tube. The baffle plates project radially outwardly from the delivery tube so that the outer edges 38 thereof may be circumscribed snugly by the inner peripheral surface 21 of the delivery tube portion 18 of shell 2. As shown the baffles 37 extend lengthwise along the tube 27 for approximately half its length.

The baffle plates 37 thus function to center the delivery tube 27 coaxially within the delivery tube portion 18 so that when fully seated therein the first conical portion 29 of the conical flange 23 fits snugly into and lies sealingly seated on the first annular conical shell surface 14 of shell 7. When this occurs, the outer peripheral edge 24 of conical flange 23 sealingly abuts the inner peripheral surface 17 of the delivery tube in a sealing relationship. Additionally, there is provided on the underside of the conical flange 23 a pair of circular beads 42 configured so that when the shell insert 3 is dropped into the outer shell 2, the circular beads 42 sealingly press against the conical surface 14 so as to prevent the passage of liquid between the two conical shell surfaces.

Figure 9:
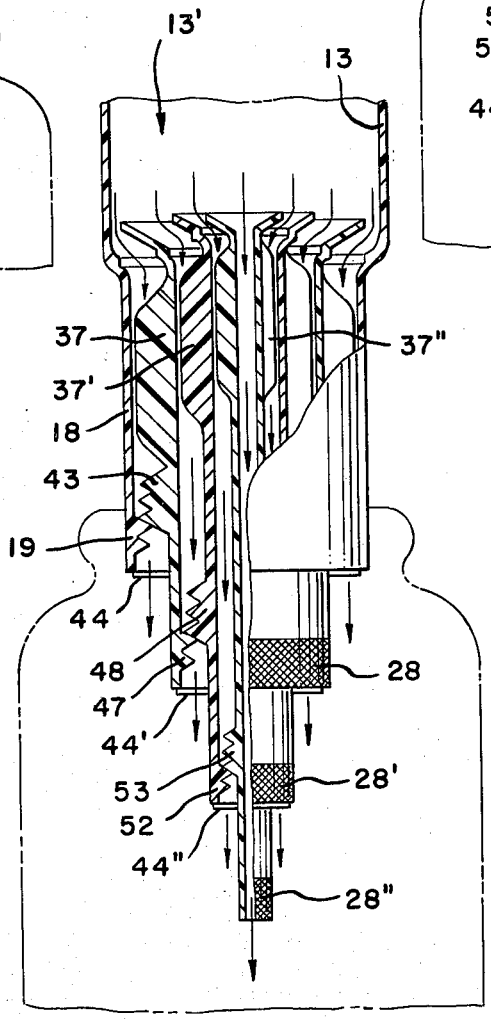
FIG. 9 is a fragmentary vertical cross-sectional view illustrating all of the delivery tube inserts adjusted to permit maximum flow through the funnel.

Sealing engagement of the shell insert 3 with the shell 2 is insured by a plurality, preferably three, threaded segments 43 formed on the outer surface 36 of the delivery tube 27. The threaded segments 43 are spaced circumferentially about the outer periphery of the delivery tube at the same intervals as the threaded segments 19 formed on the interior of delivery tube 18. The space between the threaded segments 43 is shorter in length than the length of the threaded segments so that it is necessary that the insert 3 be rotated or threaded into position by engagement of the threaded segments 43 and 19. Spaced a short distance below threaded segments 43 are radially projecting resilient and flexible nibs 44 that extend a sufficient distance that the nibs come into resilient contact with the inner periphery of the delivery tube 18 when the insert is inserted or removed so as to prevent inadvertent removal of the insert shell 3 from the insert shell 2 when the threaded segments have been disengaged as illustrated in FIG. 9.

Preferably, the nibs 44 are four in number spaced at 90° intervals around the tube and are integrally formed from the same synthetic resinous material from which the shell is formed, and project sufficiently to act or to form an interference fit with the inner periphery of the delivery tube 18. It should be noted that the axial spacing between the threaded segments 43 and the circumferentially spaced and radially projecting nibs 44 is such that when the threaded segments 43 are fully engaged with threaded segments 19 of shell 2, the nibs 44 lie spaced below the lower edge 46 of delivery tube 18. In this position of shell insert 3 the peripheral edge 24 seals against the vertical surface 17 of shell 2 and annular beads 42 squeeze down on and seal against conical surface 14 of shell 2, thus preventing liquid from passing between the two surfaces.

When the shell insert 3 is rotated to disengage threaded segments 43 and 19, the conical flange 23 of shell insert 3 lies spaced axially from the associated shell 2 and thus provides an annular passageway through which liquids may flow. When this condition or position of the parts obtains, the radially projecting nibs 44 snugly abut the lower end surface 46 of the delivery tube portion 18. Thus, even if threaded segments 43 and 19 are completely disengaged as shown in FIG. 9, the shell insert 3 will not fall out of the surrounding shell and can only be removed by forcible effort because of the interference fit provided by the flexible nibs 44.

Just as the shell member 2 and its delivery tube 13' is provided with threaded segments 19 projecting radially inwardly from the inner periphery 21 at circumferentially spaced intervals, so too the delivery tube 27 of shell insert 3 is provided with radially inwardly projecting threaded segments 47, preferably three in number and circumferentially equally spaced a distance shorter than the length of each of the segments. The threaded segments 47 are adapted to engage the threaded segments 48 disposed on the outer periphery of delivery tube 49 of shell insert 4 which is proportioned in its dimensions to be inserted within the shell insert 3.

Figure 8:
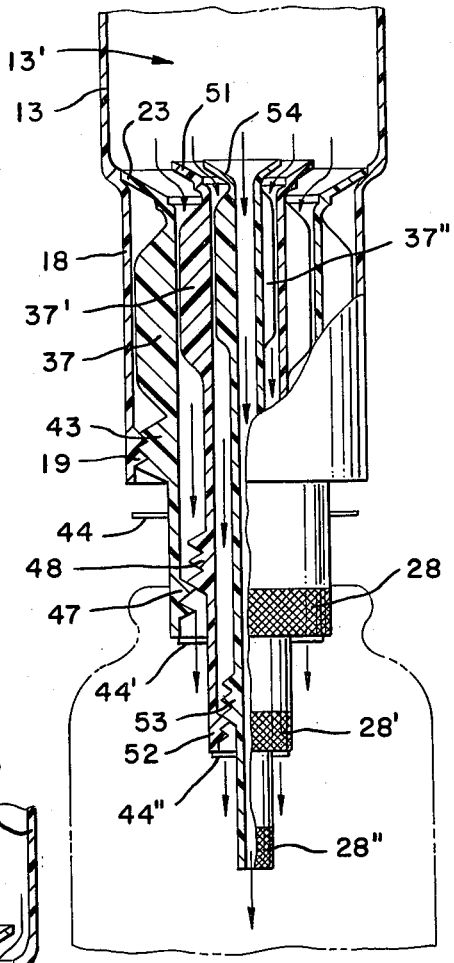
FIG. 8 is a fragmentary vertical cross-sectional view illustrating two of the delivery tube inserts adjusted to permit still more flow through the funnel.

The shell insert 4 is provided at one end with conical flange portion 51 configured to sealingly engage the complimentary conical flange portion 23 of insert 3 when threaded segments 47 and 48 are fully engaged. In the interest of brevity in this description, the relationship of the shell insert 4 in the shell insert 3 is essentially the same as the interrelationship of the insert shell 3 with the shell 2. Accordingly, instead of providing a detailed description of shell 4, like reference numbers bearing primes have been attached to like elements of the combination. Functionally, when threaded segments 47 and 48 are disengaged as illustrated in FIG. 8, a space is created between the conical flange portion 51 of insert shell 4 and conical flange 23, thus providing an annular passageway through which liquids may flow.

Forming an intergral part of shell insert 4, and more specifically forming an integral projection from the inner periphery of the delivery tube 49 adjacent its discharge end are a plurality of threaded segments 52 proportioned to threadably engage complimentary thread segments 53 formed on the outer periphery of shell insert 6. Shell insert 6 is provided at its opposite end with a conical flange portion 54 complimentary to the conical flange portion 51 of shell insert 4, and in all other respects having the same structural arrangement thereof as described in connection with shell inserts 3 and 4. Accordingly, corresponding reference numbers bearing primes have been applied to insert shell 6 to designate corresponding elements of the combination.

Figure 7:
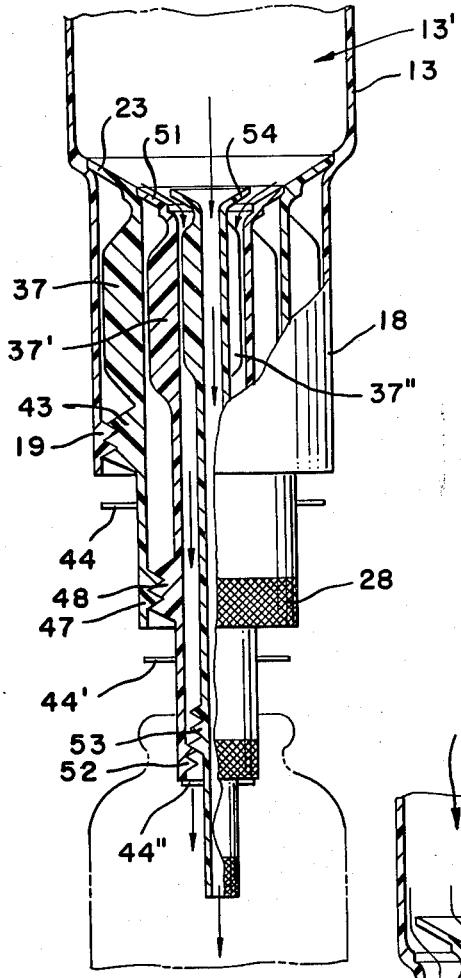
FIG. 7 is a fragmentary vertical cross-sectional view illustrating the smallest diameter delivery tube insert elevated to permit an increased flow of liquid through the funnel.

Functionally, engagement of the threaded segments 53 with the threaded segments 52 of shell insert 4 seals the conical flange portion 54 against the conical flange portion 51, thus requiring that liquids poured into the funnel construcion pass only through shell insert 6. When the threaded segments 51 and 54 are disengaged as illustrated in FIG. 7, then liquid poured into the funnel construction is permitted to pass through the annular space created between the shell insert 6 and the shell insert 4, thus causing liquid to flow downwardly through the delivery tube 49 of shell insert 4 and simultaneously flow through the delivery tube of shell insert 6.

It will thus be seen that with the shell inserts 3, 4 and 6 engaged as illustrated in FIG. 1, liquid poured into the funnel construction must necessarily flow only through the interior of shell insert 6, this being the most restrictive passage and the delivery tube of this shell insert being of the smallest diameter and being adapted for small openings in containers. If the opening in a container to be filled is somewhat larger than the delivery tube of shell insert 6, then this shell insert may be unscrewed until a space is provided between the conical flange portions 51 and 54 and the delivery tube of shell insert 4 may be inserted into the larger container opening. Now liquid poured into the funnel construction will pass through both shell inserts 4 and 6 and into the container. Shell insert 3 provides an even larger diameter delivery tube 27 for insertion in an even larger container opening. To secure the benefits of this larger diameter delivery tube all that is required is that the shell insert 4 be unscrewed to the point where a space is provided between the conical flange portions 51 and 23, thus enabling liquid to flow through all three shell inserts 3, 4 and 6 as depicted in FIG. 8. Lastly, for maximum flow, the shell inserts 3, 4 and 6 may be arranged in axially displaced relationship as illustrated in FIG. 9 to achieve maximum flow capacity from the funnel construction.

While the two extremes of flow capacity in relation to the positions of the shell inserts 3, 4 and 6 have been illustrated and described, it should be apparent that other variations are possible. For instance, it may be desirable to utilize a small flow capacity in a large diameter container opening, in which case, the arrangement as illustrated in FIG. 1 would be utilized. On the other hand, it may be desirable to utilize the flow capacity created between the shell insert 3 and the shell 2 in combination with the flow capacity of either one or both shell inserts 4 and 6. Thus, it is obvious that the funnel construction provides greater versatility in its manner of use while insuring that while the funnel construction is formed from a plurality of separate cooperating parts, those parts are not going to be separated unless that is intended by the user.

While the drawings and this description have proceeded on the basis of a funnel construction fabricated from an appropriate synthetic resinous material, it should be understood that within the spirit and scope of the appended claims the funnel construction may be fabricated from other suitable materials that may be arranged to perform the functions described above. For instance, sheet material might be used, with appropriate seal members applied to the underside conical flanges 23, 51 and 54, and with rubber or resilient nibs being appropriately applied through apertures in the delivery tubes provided for that purpose. In like manner, the baffles 37 of shell inserts 3, 4 and 6 could be fabricated as individual parts adapted to be squeezed through appropriate slots formed in a sheet metal structure and locked in place by virtue of the resilience inherent in the baffle member.

Having thus described the invention what is considered to be new and novel and sought to be covered by Letters Patent of the United States is as follows.

I claim:

1. A variable flow funnel construction comprising:

(a) a primary shell structure including a hollow shell portion integral with and communicating with a delivery tube portion; and (b) at least one shell insert adapted to fit coaxially within the delivery tube portion of said primary shell and selectively adjustable in relation thereto to provide a space therebetween or seal said space to control the flow of liquid through the funnel.

2. The combination according to claim 1, in which means are provided between said delivery tube portion and said shell insert to maintain the coaxial relationship thereof.

3. The combination according to claim 1, in which baffle means are provided on said shell insert to maintain the coaxial relationship of said shell insert with said primary shell and to channel the flow of liquid therethrough.

4. The combination according to claim 1, in which the delivery tube of said primary shell is provided with a plurality of thread segments on the inner periphery thereof spaced circumferentially thereabout, and said shell insert is provided with a plurality of threaded segments complimentary and threadably engageable with the thread segments on said delivery tube whereby said shell insert may be threadably engaged with said primary shell.

5. The combination according to claim 1, in which seal means are provided on said shell insert adapted to selectively seal the space between said shell insert and said primary shell when it is desired to diminish the flow of liquid through the funnel.

6. The combination according to claim 1, in which means are provided on said shell insert to prevent inadvertent separation of said shell insert from said primary shell.

7. The combination according to claim 1, in which a second shell insert is provided adapted to fit coaxially within said first mentioned shell insert and selectively adjustable in relation to said first mentioned shell insert to provide a space therebetween or seal said space to control the flow of liquid through the funnel.

8. The combination according to claim 1, in which a plurality of coaxially arranged shell inserts are provided adapted to be telescoped together as a sub-assembly with each shell insert being separately and selectively adjustable axially in relation to the remaining shell inserts, said sub-assembly of shell inserts being adapted to fit coaxially within the delivery tube portion of said primary shell whereby selective adjustment of one or more of said shell inserts controls the flow of liquid through the funnel.

9. The combination according to claim 1, in which said hollow shell portion is generally conical in its configuration including an open base end and an apex end, and said delivery tube is integral with the apex end thereof.

10. The combination according to claim 1, in which said delivery tube portion of said primary shell includes integral upper and lower sections arranged end-to-end and said shell insert is coaxially disposed within said lower section.

11. The combination according to claim 1, in which said delivery tube portion of said primary shell includes a first section of one diameter and a second section of a smaller diameter, and said shell insert is coaxially disposed within said smaller diameter section.

12. The combination according to claim 1, in which said delivery tube portion of said primary shell includes a first section next adjacent said hollow shell portion and integral therewith at one end and a second section remote from said hollow shell portion and integral with the other end of said first section and coaxially arranged therewith.

13. The combination according to claim 1, in which said delivery tube portion of said primary shell includes;

(1) a first section of one diameter;

(2) a second section of a smaller diameter;

(3) a generally conical intermediate section integrally interconnecting said first and section sections; and (4) said shell insert is coaxially disposed within said smaller diameter section and includes:

(1) a generally conical truncated flange portion having an apex end and a base end and adapted to selectively sealingly seat on said conical intermediate section;

(2) a delivery tube portion integral with the apex end of said conical truncated flange portion and extending coaxially through said second section of smaller diameter of said delivery tube of the primary shell and defining an annular passageway therebetween;

(3) a plurality of elongated baffle plates disposed in said annular passageway to retain the shell insert coaxially disposed within said primary shell;

(4) means on said delivery tube portion adjustably engaging said second section of smaller diameter of said delivery tube of the primary shell whereby rotation of said shell insert effects axial displacement thereof to selectively sealingly seat said conical truncated flange portion on said conical intermediate section or provide a space therebetween.

14. The combination according to claim 1, in which said hollow shell portion of the primary shell structure comprises a truncated conical shell portion having a base end and an apex end, and said delivery tube portion is integral with the apex end of said truncated conical shell portion.

15. The combination according to claim 1, in which an assembly of three shell inserts are provided, the shell inserts of said assembly including a shell insert of a first diameter to define with said delivery tube portion of the primary shell an annular passageway through which liquid may flow, a shell insert of a second smaller diameter coaxially disposed within said shell insert of a first diameter to define therewith an annular passageway through which liquid may flow, and a shell insert of a third smaller diameter coaxially disposed within said shell insert of a second diameter to define therewith an annular passageway through which liquid may flow, and means interengaging said shell inserts whereby a selected one or ones may be rotated in relation to the others to control the flow of liquid through said annular passageways.

* * * * *